US009850602B2

(12) United States Patent
Wrobel

(10) Patent No.: US 9,850,602 B2
(45) Date of Patent: Dec. 26, 2017

(54) BRAIDING DISK HANDLE

(71) Applicant: Thomas Wrobel, Allenstown, NH (US)

(72) Inventor: Thomas Wrobel, Allenstown, NH (US)

(73) Assignee: Thomas Wrobel, Allenstown, NH (US)

( * ) Notice: Subject to any disclaimer, the term of this patent is extended or adjusted under 35 U.S.C. 154(b) by 455 days.

(21) Appl. No.: 14/645,018

(22) Filed: Mar. 11, 2015

(65) Prior Publication Data

US 2015/0259835 A1 Sep. 17, 2015

Related U.S. Application Data

(60) Provisional application No. 61/953,087, filed on Mar. 14, 2014.

(51) Int. Cl.
*D04C 7/00* (2006.01)

(52) U.S. Cl.
CPC ..... *D04C 7/00* (2013.01)

(58) Field of Classification Search
CPC ..... D04C 7/00
See application file for complete search history.

(56) References Cited

U.S. PATENT DOCUMENTS 222,937 A * 12/1879 Newcomb ..... D04B 39/00 66/4
1,181,297 A * 5/1916 Fenlason ..... B21F 15/04 140/118
1,318,465 A * 10/1919 Seifarth ..... D04B 39/00 66/4
1,433,868 A * 10/1922 Ashley ..... D04C 1/12 87/8

(Continued)

FOREIGN PATENT DOCUMENTS

DE 199 14 878 A1 10/2000
DE 10 2006 009385 A1 3/2007
JP 2003-171854 A 6/2003

OTHER PUBLICATIONS

Clover, "French Knitter—Bead Jewelry Maker—3 Interchangeable Heads Included", Sep. 30, 2012, Retrieved from the Internet: URL: http://www.fomast.com/media/Uutuudet/French_en_0523.pdf [retrieved on Jun. 11, 2015], 2 pages.

(Continued)

*Primary Examiner* — Shaun R Hurley
(74) *Attorney, Agent, or Firm* — Finch & Maloney PLLC

(57) ABSTRACT

Disclosed is a braiding disk handle for holding a kumihimo braiding disk. The braiding disk handle includes a tubular grip having a proximal end, a distal end, and a chamber extending between and through the proximal and distal ends. The grip is configured and adapted to receive a length of yarn through the extent of the chamber. The handle further includes a hollow shank attached to the distal end of the grip such that the chamber of the grip is in communication with the hollow of the shank. The shank is configured and adapted to cooperatively and detachably mate with an opening of a braiding disk. The handle further includes a shoulder formed at the distal end of the grip adjacent and perpendicular to the shank. The shoulder is configured and adapted to support at least a portion of the braiding disk while the shank is mated with braiding disk.

20 Claims, 7 Drawing Sheets

(56) References Cited

U.S. PATENT DOCUMENTS 1,515,470 A * 11/1924 Foulder ..... B65B 13/285 140/119
2,658,364 A * 11/1953 Carlson ..... D04B 3/00 66/4
D182,269 S * 3/1958 Brown ..... D3/25
3,648,484 A * 3/1972 Gordon ..... D04B 9/44 66/4
3,650,010 A * 3/1972 Powell, Jr. ..... D04D 9/00 29/241
4,285,114 A * 8/1981 Underdahl ..... A47J 31/053 221/210
4,380,296 A * 4/1983 Murray ..... A47F 7/005 206/388
D316,611 S * 4/1991 Spina ..... D26/113
5,036,446 A * 7/1991 Quintanilla ..... F21V 21/403 206/223
5,065,296 A * 11/1991 Cude ..... F21V 21/403 16/421
5,072,539 A * 12/1991 Greenberg ..... A01K 97/10 211/70.2
D330,982 S * 11/1992 Braun ..... D6/680.2
5,279,080 A * 1/1994 Muller ..... A45D 26/0004 451/449
5,465,461 A * 11/1995 Sandel ..... B25G 1/02 16/421
5,502,860 A * 4/1996 Franke ..... A46B 5/0062 15/145
5,709,465 A * 1/1998 Lanzone ..... F21V 21/406 362/399
5,752,551 A * 5/1998 Trueblood ..... H02G 1/085 140/118
5,853,033 A * 12/1998 Kavanagh ..... H02G 1/1292 140/123
5,887,496 A * 3/1999 Pollard ..... B25B 13/50 81/176.15
5,934,966 A * 8/1999 Ward ..... A63B 65/10 446/46
D421,148 S * 2/2000 Borders ..... D26/113
RE37,190 E * 5/2001 Stowell ..... B25G 1/10 16/110.1
6,390,659 B1 * 5/2002 Saad ..... F21V 21/403 206/438
6,863,075 B2 * 3/2005 Wells ..... A45D 44/02 132/201
7,444,917 B1 * 11/2008 Elliott ..... D04C 7/00 87/62
7,695,432 B2 * 4/2010 Scheyer ..... A61B 1/00177 600/184
8,051,538 B2 * 11/2011 Hsieh ..... B25G 1/102 16/430
8,136,337 B2 * 3/2012 Jackson ..... H01R 4/12 57/1 UN
8,722,121 B2 * 5/2014 Conway, Jr. ..... A23G 3/563 426/104
8,746,753 B2 * 6/2014 Crorey ..... D04G 5/00 289/13
8,789,243 B2 * 7/2014 Denmark ..... B25G 1/10 16/421
2007/0283559 A1 * 12/2007 Jackson ..... B21F 7/00 29/748
2008/0053558 A1 * 3/2008 Rodriguez ..... H01R 4/12 140/118
2009/0308483 A1 * 12/2009 James ..... B21F 7/00 140/120
2015/0322599 A1 * 11/2015 Thompson ..... D04C 7/00 87/33

OTHER PUBLICATIONS

European Extended Search Report for European Application No. 15159119.5 dated Jun. 22, 2015, 8 pages.

* cited by examiner

BRAIDING DISK HANDLE

RELATED APPLICATION

This application claims the benefit under 35 U.S.C. §119 (e) of U.S. Provisional Patent Application Ser. No. 61/953,087, entitled "Braiding Disk Handle" and filed Mar. 14, 2014, which is incorporated herein by reference in its entirety.

FIELD OF THE DISCLOSURE

This disclosure relates to a braiding apparatus, and more particularly, to a handle for holding a braiding disk.

BACKGROUND

Kumihimo is a form of Japanese braiding using strands of yarn to form ribbons or cords. A kumihimo disk is a specialized tool that can be used as a hand-held frame for forming a kumihimo braid. Kumihimo disks are commonly made of a firm but flexible self-healing foam material about six inches in diameter with an opening or hole in the center, although other materials and sizes can be used. The disk has notches formed around the circumference to temporarily retain and provide tension on the strands, or warps, during braiding. Numbers or symbols may be printed on the upper face of the disk adjacent to each notch as a guide. During braiding, the yarn or yarns pass through the hole in the disk. While one end of the yarn is held in tension below the disk (e.g., by pulling on the yarn or tying weights to the end), the warps are alternately drawn in sequence from one notch to another across the upper face of the disk to create the desired braid. In some cases, beads or other decorations may be incorporated into the braid as well. Generally, the disk is alternately held with one hand, while a portion of the braid is formed with the other hand by drawing a warp across the disk (e.g., left hand holds disk while right hand forms a braid, followed by right hand holds disk while left hand forms braid, and so on in an alternating pattern). However, handling kumihimo disks in this manner can be rough on one's hands and may cause cramps or other physical discomfort, especially in those with arthritis or advanced age.

SUMMARY

According to an embodiment of the present disclosure, a braiding disk handle includes a tubular grip having a proximal end, a distal end, and a chamber extending between and through the proximal and distal ends. The grip is configured and adapted to receive a length of yarn through the extent of the chamber. The handle further includes a hollow shank attached to the distal end of the grip such that the chamber of the grip is in communication with the hollow of the shank. The shank is configured and adapted to cooperatively and detachably mate with an opening of a braiding disk. The handle further includes a shoulder formed at the distal end of the grip adjacent and perpendicular to the shank. The shoulder is configured and adapted to support at least a portion of the braiding disk while the shank is mated with braiding disk.

In some embodiments, the tubular grip has a contoured outer surface. In some embodiments, an overall diameter of the handle is greatest at the shoulder. In some embodiments, the shank has a length of about three-eighths of one inch. In some embodiments, the shoulder has a width of about one-half of one inch. In some embodiments, the chamber has a diameter of less than about one inch. In some embodiments, the shank has a circular cross-section. In some embodiments, the shank has a polygonal cross-section. In some embodiments, the grip, the shank and the shoulder are formed of a rigid material as a unitary structural member.

According to another embodiment, a braiding device includes a braiding disk and a braiding handle removably coupled to the braiding disk. The braiding disk has a center and a circumference, an opening in the center, and a plurality of notches around the circumference for receiving strands or threads of a yarn. The braiding handle includes a tubular grip, a hollow shank, and a shoulder. The tubular grip has a proximal end, a distal end, and a chamber extending between and through the proximal and distal ends. The grip is configured and adapted to receive a length of the yarn through the extent of the chamber. The hollow shank is attached to the distal end of the grip such that the chamber of the grip is in communication with the hollow of the shank. The shank is detachably mated with the opening of the braiding disk. The shoulder is formed at the distal end of the grip adjacent and perpendicular to the shank. The shoulder is configured and adapted to support at least a portion of the braiding disk while the shank is mated with braiding disk.

According to yet another embodiment, a kit includes a braiding disk and a braiding disk handle as variously described in this disclosure.

According to yet another embodiment, a method of braiding a yarn includes mounting a braiding disk handle to a braiding disk, where the braiding disk has an opening therethrough and the braiding disk handle has a chamber extending therethrough. The method further includes threading a yarn through the opening in the braiding disk and through the chamber in the braiding disk handle.

Numerous configurations and variations will be apparent in light of this disclosure.

BRIEF DESCRIPTION OF THE DRAWINGS

The accompanying drawings are not intended to be drawn to scale. In the drawings, each identical or nearly identical component that is illustrated in various figures is represented by a like numeral.

DETAILED DESCRIPTION

Kumihimo braiding techniques have existed since at least the Nara Period of Japanese history, and possibly earlier (c. 645-784 AD). Kumihimo disks simplify the braiding process and have been popular among crafters for many years. As noted above, kumihimo disks are typically held in one hand with the disk generally facing upward, while the other hand is used for braiding.

However, such handling of the disk often requires the user to hold or pinch the disk between several fingers, which can cause physical discomfort for some people. Furthermore, direct handling of the disk during braiding requires repetitive twisting of the hand, wrist and arm, which is an ergonomically incorrect design that can lead to repetitive strain injuries or other physical disorders. Thus, techniques for improving the ergonomics and comfort of using kumihimo disks are needed.

Figure 1:
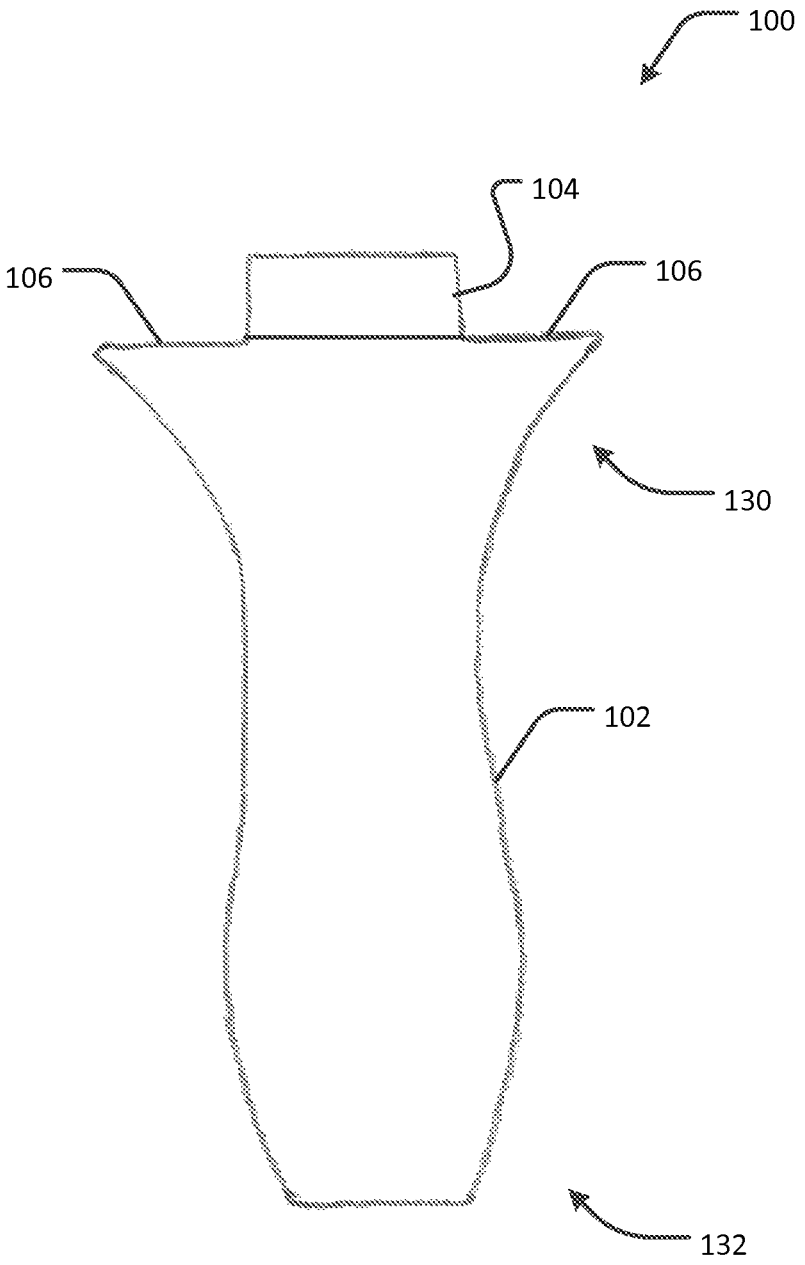
FIG. 1 is a side view of an example braiding disk handle, in accordance with an embodiment of the present disclosure.
Figure 2:
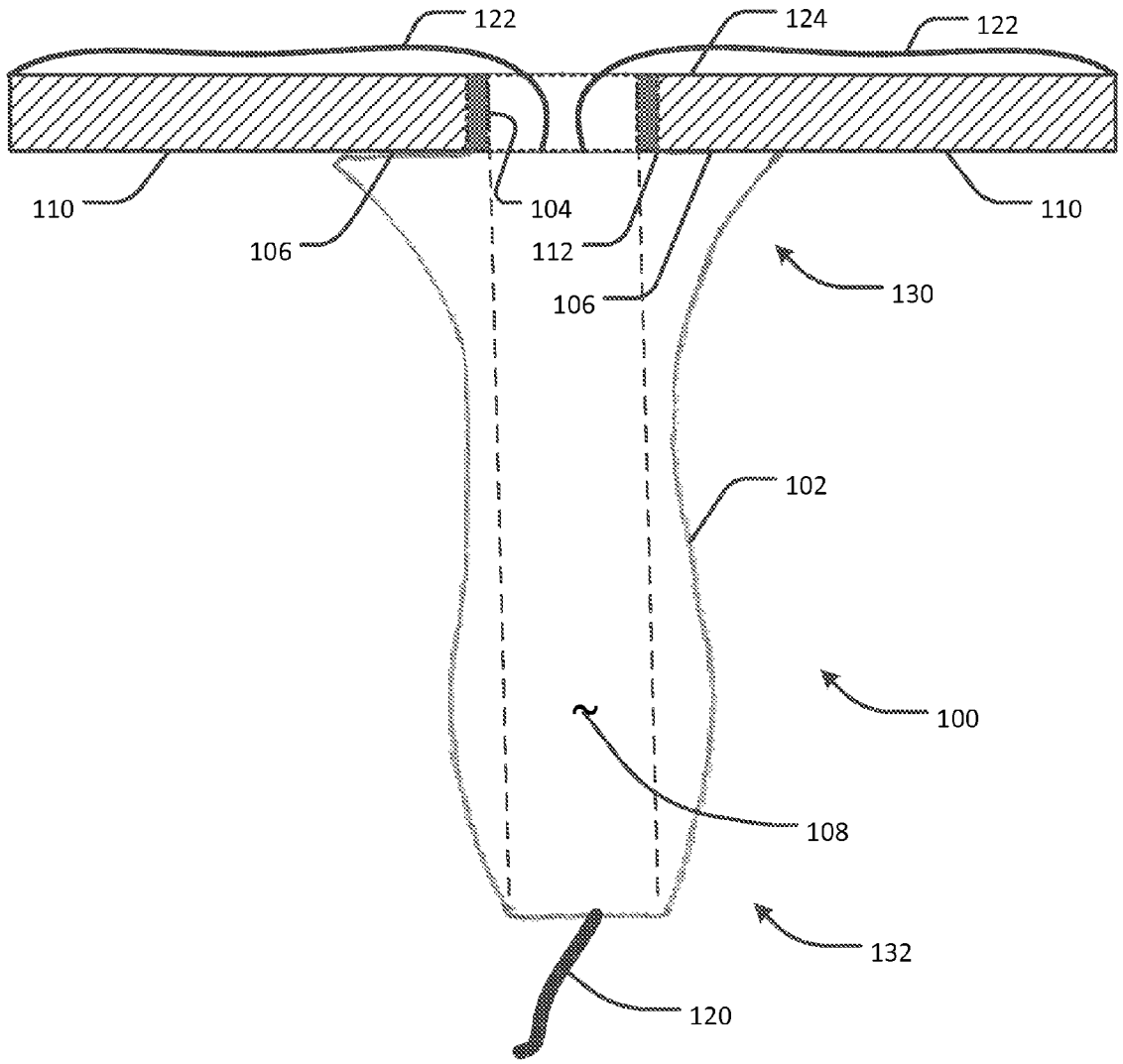
FIG. 2 is a partial cross-sectional side view of the example braiding disk handle of FIG. 1, in accordance with an embodiment of the present disclosure.

To this end, a detachable, elongated handle is disclosed for holding a braiding disk, such as a kumihimo disk. FIG. 1 is a side view of an example braiding disk handle 100, in accordance with an embodiment. FIG. 2 is a partial cross-sectional side view of the example braiding disk handle 100 of FIG. 1 inserted into a braiding disk 110. The braiding disk 110 has an opening 112 (e.g., a hole) at or near its center. The handle 100 has a generally tubular grip 102 and a hollow shank 104 (shown in cross-section in FIG. 2) at a distal end 130 of the grip 102. The shank 104 is configured and adapted to cooperatively and detachably mate with the center opening 112 of the braiding disk 110 (such as shown in cross-section in FIG. 2). The grip 102 includes a shoulder portion 106 adjacent and perpendicular to the shank 104 that lies flush with the underside of the disk 110 when the shank 104 is mated with the disk 110 and provides additional support of the disk 110 during use. The grip 102 has a chamber 108, or aperture, (shown in FIGS. 2, 3A-D, 4 and 6) extending longitudinally through the handle 100 between and through the distal end 130 and a proximal end 132. The chamber 108 is in communication with the hollow of the shank 104 such that an opening extends along the entire length of the handle from end-to-end for receiving a length of yarn 120.

In use, the shank 104 of the handle 100 is inserted into the opening 112 of the braiding disk 110 such that the grip 102 extends perpendicularly outward from the disk. The handle 100 can then be held with one hand, with the disk 110 facing upward, at a more comfortable wrist angle than holding the disk 110 directly. Rotating the handle 100 causes the disk 110 to rotate accordingly. Yarn 120 or other braiding material (e.g., strings, threads, or other flexible strands of material) can be threaded through the opening 112 in the braiding disk and through the entire length of the chamber 108 from top to bottom, such that one end of the yarn can be accessed through the bottom of the handle 100, and the other end of the yarn can be separated into warps 122, extended over the upper face 124 of the disk 110 and retained in the circumferential notches 114 (see, e.g., FIG. 4). Thus, when using the handle 100, the user can hold the handle 100 in one hand continuously while braiding with the other hand continuously. This eliminates the need to alternate the braiding and disk holding hands during the braiding process, such as done when using a braiding disk without the handle 100. Note that FIG. 2 is not necessarily drawn to scale and that in practice the warps 122 can be stretched tightly across the face 124 of the disk 110 without slack.

In some cases, the grip 102 of the handle 100 can be contoured in any number of ways for further comfort and feel. Further, the cross-section of the shank 104 can be round, square, rectangular, star-shaped, or any other shape that conforms to the shape of the opening in the disk 110, such as described with respect to FIGS. 3A-3D. In some embodiments, the braiding disk 110 is round, square, hexagonal, octagonal, or other polygonal shape of varying diameter.

The handle 100 can be made of plastic, rubber, wood, metal or any other suitable material or combination of such materials. In some cases, the grip 102, the shank 104, the shoulder 106, or any combination of these, are formed of a rigid material as a unitary structural member (e.g., a single piece or a combination of pieces that are molded, bonded, welded or otherwise joined together during or subsequent to manufacture). Chamber 108 can be molded into handle 100 or may be formed in a secondary process such as machining out chamber 108 from a solid piece. The materials used to form the handle 100 may, for example, be lightweight and inexpensive yet sufficiently rigid and sturdy to prevent bending, folding, crushing or breaking under normal use as a braiding tool.

Figure 3A:
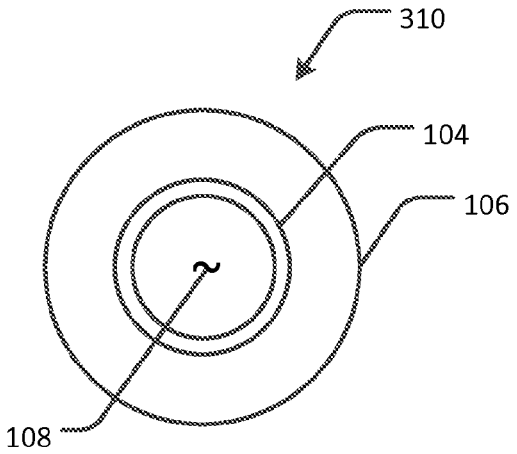
FIGS. 3A-3D show top views of several example braiding disk handles, in accordance with various embodiments of the present disclosure.
Figure 3B:
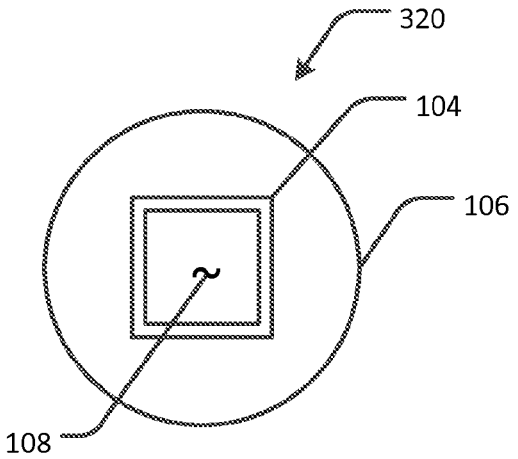
Figure 3C:
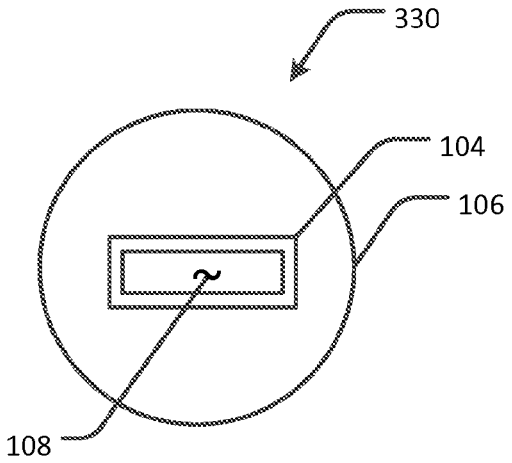
Figure 3D:
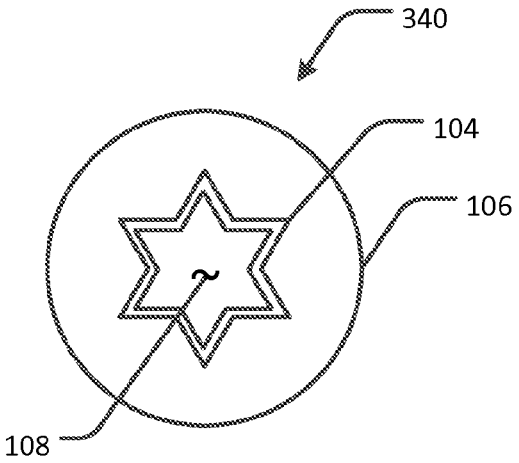

FIGS. 3A-3D show top-down views of several example braiding disk handles 310, 320, 330, 340, in accordance with various embodiments. FIG. 3A shows an example handle 310 having a round shank 104. FIG. 3B shows an example handle 320 having a square shank 104. FIG. 3C shows an example handle 330 having a rectangular shank 104. FIG. 3D shows an example handle 340 having a star-shaped shank 104. As will be apparent in view of this disclosure, the shank 104 can have other shapes without departing from the scope of the invention.

Figure 4:
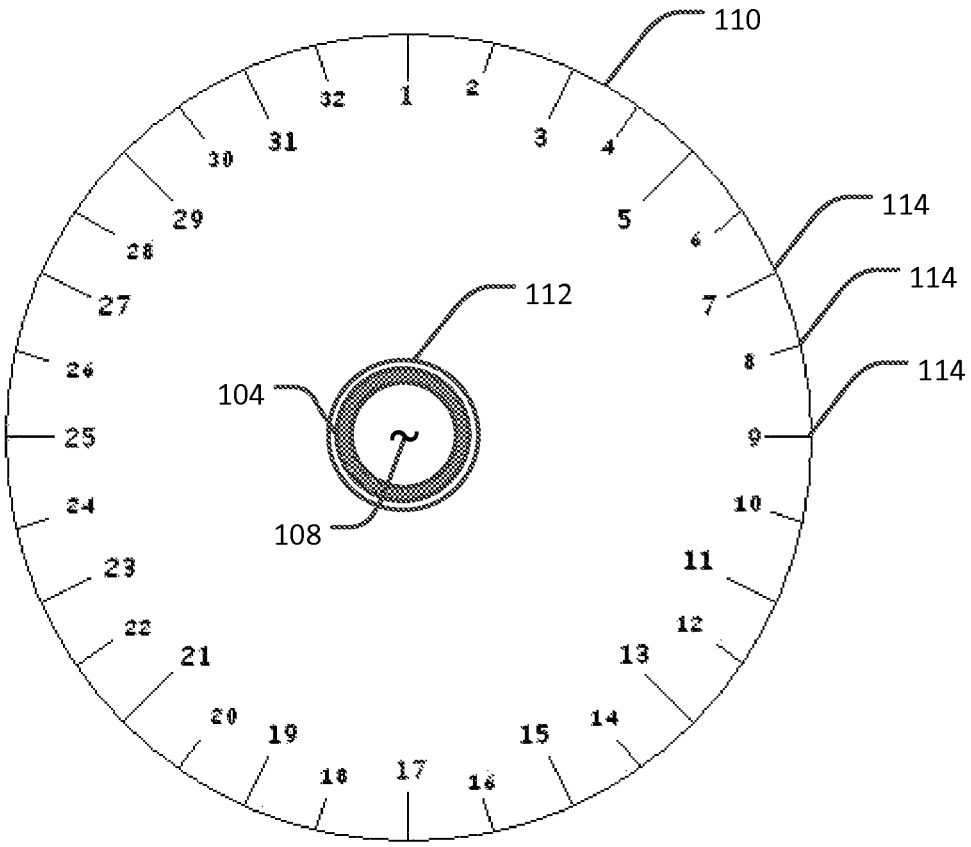
FIG. 4 is a top view of the example handle of FIG. 1 and a braiding disk, in accordance with an embodiment of the present disclosure.

FIG. 4 is a top view of the example braiding disk handle 100 and braiding disk 110 of FIG. 1, in accordance with an embodiment. FIG. 4 is not necessarily drawn to scale. For clarity of description, a small gap is shown in FIG. 4 between the shank 104 of the handle 100 and the opening 112 of the disk 110 to show the elements distinctly; however, it will be understood that in some embodiments the shank 104 has a size and shape such that it fits snugly into the opening 112 without any substantial gap between the two.

Figure 5:
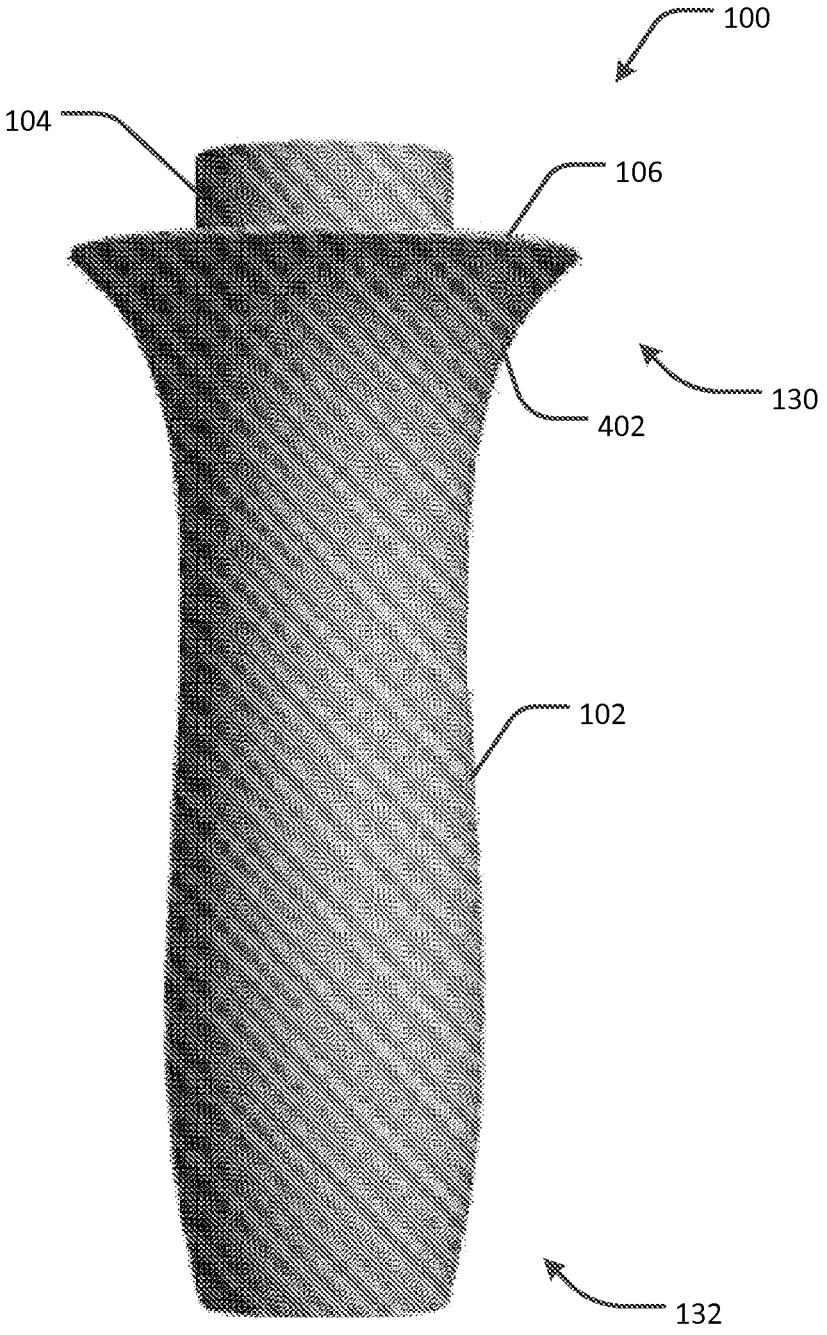
FIG. 5 is a side perspective view of the example handle of FIG. 1, in accordance with an embodiment of the present disclosure.

FIG. 5 is a side perspective view of the example braiding disk handle 100 of FIG. 1. In some embodiments, the handle 100 is substantially cylindrical and includes a tapered portion 402 below the shoulder 106 and a contoured grip 102 for improved comfort and appearance. It will be understood that the handle 100 can have other suitable shapes or contours. For example, the handle may be substantially T-shaped. In some cases, the surface of the grip 102 can be textured, such as with a ribbed or pebbled surface, or with a rubberized material to improve grip. The surface of the grip 102 may include substantially horizontal ridges or grooves having widths that approximate the width of the user's fingers. For example, one, two, three or more ridges and/or grooves may be coaxial around the handle and may be separated by about a fingers width, for instance, 1 centimeters (cm), 1.5 cm or 2 cm. Aside from the chamber 108, the remainder of the handle 100 may be solid, hollow or partially hollow.

Figure 6:
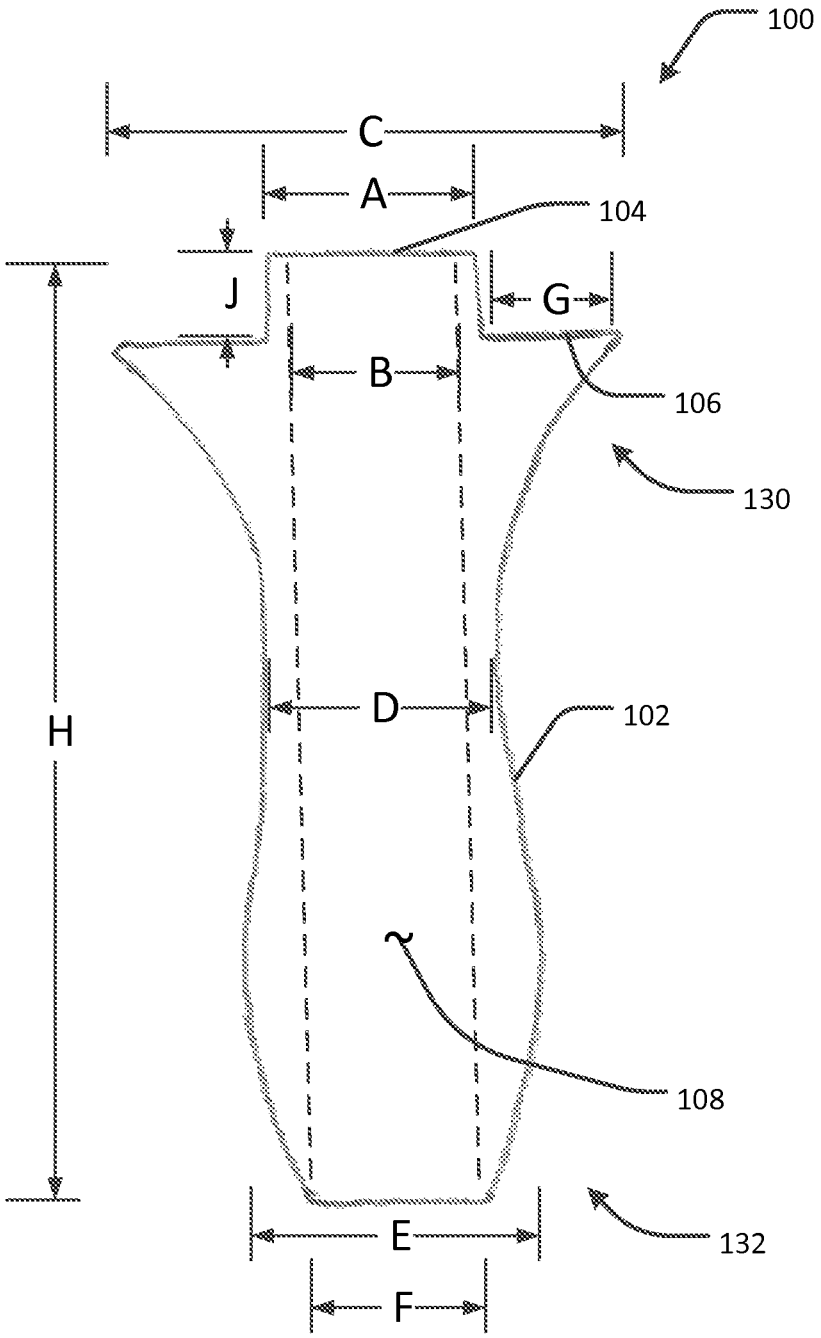
FIG. 6 is a cross-sectional side view of an example braiding disk handle, in accordance with an embodiment of the present disclosure.

FIG. 6 is a cross-sectional side view of the example braiding disk handle 100 of FIG. 1, showing dimensions in accordance with an embodiment of the present disclosure. It will be appreciated that the dimensions described in this paragraph are only examples, and that any one or more of these dimensions can be varied without departing from the scope of the invention, as will be apparent in view of this disclosure. Certain examples are given in the table below; each example value is approximate and is not intended to be limiting to the exact values given.

| Dimension | Description | Example Values (approximate) |
|---|---|---|
| A | Diameter, shank (104), minimum | 1 inch, 20 millimeters, 35 millimeters |
| B | Diameter, chamber (108), minimum | 29/32 inches |
| C | Width, overall | 2 inches |
| D | Width, grip (102), minimum | 1⅛ inches |
| E | Width, grip (102), maximum | 1¼ inches |
| F | Width, base | 1 inch |
| G | Width, shoulder (106) | ½ inch |
| H | Height, overall | 4½ inches |
| J | Height, shank (104) | ⅜ inch, 12 millimeters, thickness of a kumihimo disk |

Figure 7:
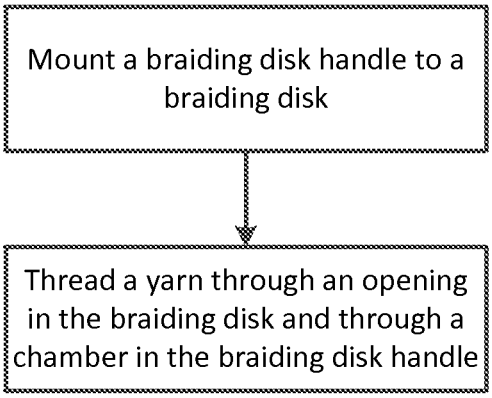
FIG. 7 is a flow diagram of a method of braiding a yarn, in accordance with an embodiment of the present disclosure.

FIG. 7 is a flow diagram of a method of braiding a yarn, in accordance with an embodiment. The method includes mounting a braiding disk handle to a braiding disk, and threading a yarn through an opening in the braiding disk and through a chamber in the braiding disk handle. In some cases, the braiding disk handle is held by a user in one hand while a braid is formed using the braiding disk using the other hand. In this manner, the user does not need to alternate hands when holding the disk and braiding, as is done when using the disk without the handle. The method may be used, for example, in conjunction with various embodiments of a braiding disk handle and braiding disk, such as those described throughout this specification.

The foregoing description and drawings of various embodiments are presented by way of example only. These examples are not intended to be exhaustive or to limit the invention to the precise forms disclosed. Alterations, modifications, and variations will be apparent in light of this disclosure and are intended to be within the scope of the invention as set forth in the claims.

What is claimed is:

1. A braiding device, comprising:

a braiding disk having a center and a circumference, an opening in the center, and a plurality of notches around the circumference for receiving strands of a yarn; and a braiding disk handle removably coupled to the braiding disk, the braiding disk handle including:

a tubular grip having a proximal end, a distal end, and a chamber extending between and through the proximal and distal ends, the grip being configured and adapted to receive a length of the yarn through the extent of the chamber;

a hollow shank attached to the distal end of the grip such that the chamber of the grip is in communication with the hollow of the shank, the shank further being detachably mated with the opening of the braiding disk; and a shoulder formed at the distal end of the grip adjacent and perpendicular to the shank, the shoulder being configured and adapted to support at least a portion of the braiding disk while the shank is mated with braiding disk.

2. The device of claim 1, wherein the tubular grip has a contoured outer surface.

3. The device of claim 1, wherein an overall diameter of the handle is greatest at the shoulder.

4. The device of claim 1, wherein the shank has a length of three-eighths of one inch.

5. The device of claim 1, wherein the shoulder has a width of one-half of one inch.

6. The device of claim 1, wherein the chamber has a diameter of less than one inch.

7. The device of claim 1, wherein the shank has a circular cross-section.

8. The device of claim 1, wherein the shank has a polygonal cross-section.

9. The device of claim 1, wherein the grip, the shank and the shoulder are formed of a rigid material as a unitary structural member.

10. A method of braiding a yarn, the method comprising:

mounting a braiding disk handle to a braiding disk, the braiding disk having an opening therethrough, the braiding disk handle having a chamber extending therethrough; and threading a yarn through the opening in the braiding disk and through the chamber in the braiding disk handle.

11. The method of claim 10, wherein:

the braiding disk has a center and a circumference, the opening being in the center, and a plurality of notches around the circumference for receiving strands of the yarn; and the braiding disk handle includes:

a tubular gip having a proximal end, a distal end, and a chamber extending between and through the proximal and distal ends, the grip being configured and adapted to receive a length of the yarn through the extent of the chamber;

a hollow shank attached to the distal end of the grip such that the chamber of the grip is in communication with the hollow of the shank, the shank being configured and adapted to cooperatively and detachably mate with the opening of the braiding disk; and a shoulder formed at the distal end of the grip adjacent and perpendicular to the shank, the shoulder being configured and adapted to support at least a portion of the braiding disk while the shank is mated with braiding disk.

12. The device of claim 1, wherein the shoulder lies flush with an underside of the braiding disk while the shank is mated to the braiding disk.

13. The device of claim 1, wherein the handle is configured and adapted such that the shank of the handle is inserted into the opening of the braiding disk and such that the grip extends perpendicularly outward from the braiding disk.

14. The method of claim 11, wherein the tubular gip has a contoured outer surface.

15. The method of claim 11, wherein an overall diameter of the handle is greatest at the shoulder.

16. The method of claim 11, wherein the shank has a circular cross-section.

17. The method of claim 11, wherein the shank has a polygonal cross-section.

18. The method of claim 11, wherein the grip, the shank and the shoulder are formed of a rigid material as a unitary structural member.

19. The method of claim 11, wherein the shoulder lies flush with an underside of the braiding disk while the shank is mated to the braiding disk.

20. The method of claim 11, wherein the handle is configured and adapted such that the shank of the handle is inserted into the opening of the braiding disk and such that the grip extends perpendicularly outward from the braiding disk.

* * * * *